US005690317A

United States Patent [19]

Sandsborg

[11] Patent Number: 5,690,317

[45] Date of Patent: Nov. 25, 1997

[54] CONTROL MECHANISM FOR SCREEN ROLLERS

[76] Inventor: Anders Sandsborg, Sandbackshult 4070, Blomstermale, Sweden, S-384 91

[21] Appl. No.: 610,283

[22] Filed: Mar. 4, 1996

[30] Foreign Application Priority Data

Sep. 9, 1994 [SE] Sweden ..... 9403001

[51] Int. Cl.[6] ..... E04H 17/00

[52] U.S. Cl. ..... 256/1; 256/24; 403/105; 160/300; 160/302; 188/82.3

[58] Field of Search ..... 256/1, 24; 403/105; 160/238, 300, 301, 302, 303; 188/82.3, 82.34, 82.4, 82.7

[56] References Cited

U.S. PATENT DOCUMENTS

| | | | |
|---|---|---|---|
| 125,712 | 4/1872 | Wollensak | 160/300 |
| 1,053,658 | 2/1913 | Sinclair | 160/300 |
| 1,099,360 | 6/1914 | Harris | 160/300 |
| 1,235,451 | 7/1917 | Evans | 160/300 |
| 1,336,953 | 4/1920 | Gervig | 160/300 X |
| 1,729,133 | 9/1929 | Shonnard | 160/300 X |
| 2,114,278 | 4/1938 | Cazes | 188/82.3 |
| 2,119,408 | 5/1938 | Wilson | 160/301 |
| 2,521,178 | 9/1950 | Meletti | 160/302 |
| 3,670,855 | 6/1972 | Lemery | 188/82.3 |
| 3,906,816 | 9/1975 | Nepote | 188/82.3 X |
| 4,124,196 | 11/1978 | Hipskind | 256/1 |
| 4,130,028 | 12/1978 | Solberg | 160/302 X |
| 4,359,197 | 11/1982 | Neufeld | 188/82.4 X |
| 4,474,339 | 10/1984 | Sato | 188/82.3 X |
| 4,844,420 | 7/1989 | Oster | 256/1 |
| 5,029,819 | 7/1991 | Kane | 256/24 |
| 5,174,073 | 12/1992 | Sabo | 160/302 X |

FOREIGN PATENT DOCUMENTS

| | | | |
|---|---|---|---|
| 68441 | of 0000 | Germany | 160/303 |
| 3103 | 11/1862 | United Kingdom | 160/300 |
| 5152 | 3/1892 | United Kingdom | 160/300 |

*Primary Examiner*—Anthony Knight
*Assistant Examiner*—Bruce A. Lev
*Attorney, Agent, or Firm*—Fasth Law Firm

[57] ABSTRACT

A spring roller-mounted pull-out screen for use as a child safety barrier across a doorway has a control mechanism which prevents the screen from extending when impacted by a child. The roller is locked against rotation in a direction allowing the screen to unwind unless released by a manual push-button. The roller automatically locks after the screen has been extended and fitted in place. The automatic locking mechanism operates by a friction drive which releases a pawl to spring into engagement with a ratchet wheel when the screen has been pulled out and released.

14 Claims, 5 Drawing Sheets

FIG. 3
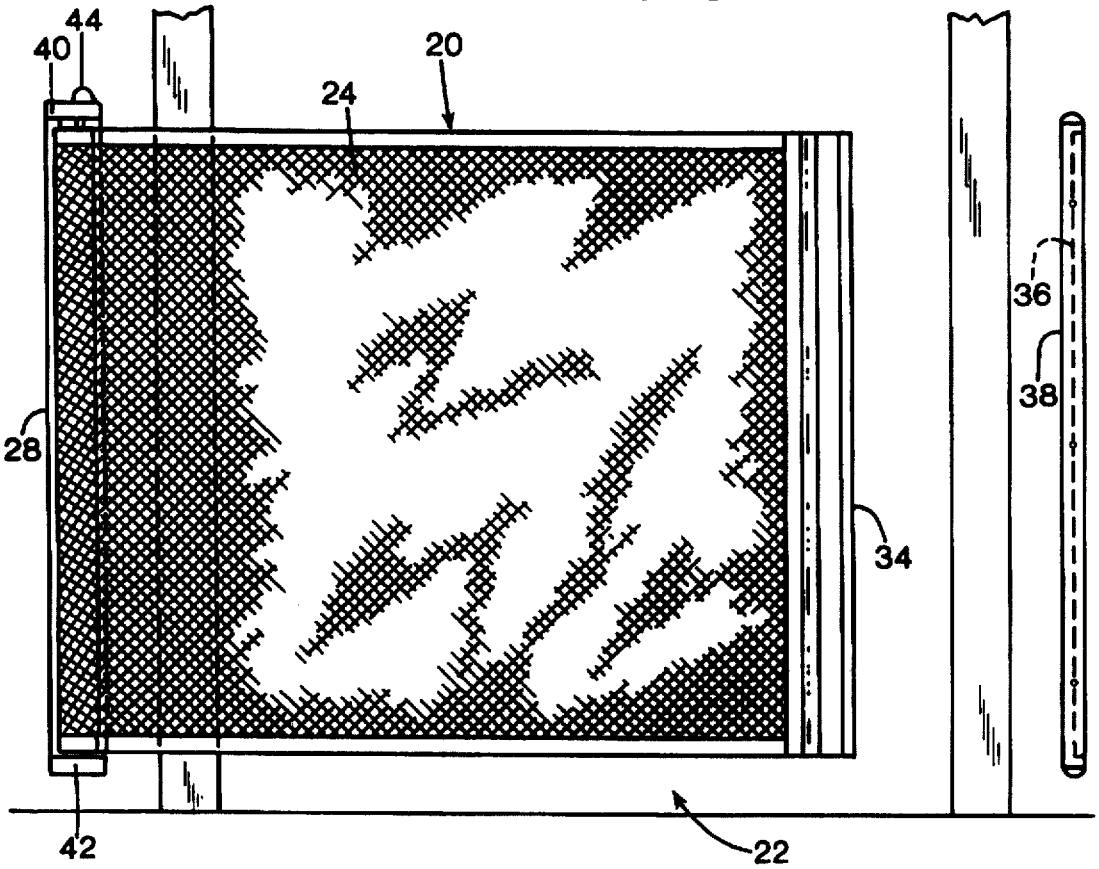
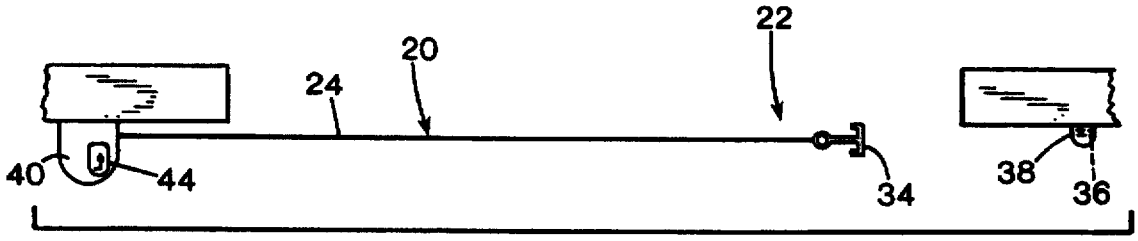
FIG. 4

CONTROL MECHANISM FOR SCREEN ROLLERS

BACKGROUND OF THE INVENTION

This invention relates, in one of its aspects, to a spring roller-mounted pull-out safety screen of the kind which may be used for child restraint across a doorway, for example, or in an automobile or the like. More particularly, the invention relates to a control mechanism which allows such a screen to be extended by a required amount and locked against further extension so that, for example, should a child impact with the screen the screen being effectively inextendable will form a barrier arresting the child's movement. By contrast, in commonly used pull-out roller blind-type structures for example, when the blind is pulled out and arrested in a required position, there is no mechanism which locks the blind against further extension. Such structures could not therefore form effective child safety screens or barriers, since they can extend on impact.

In its broader aspects, the invention relates to a control mechanism for selectively permitting or arresting the rotation or other movement of a first body, such as the roller of a safety screen in the above example, by movement of a second arresting body selectively into and out of engagement with the first body. The invention finds application in diverse fields other than child safety screens.

SUMMARY OF THE INVENTION

In its broader aspect, as alluded to above the invention provides a control mechanism for selectively permitting or arresting the rotation or other movement of a first body by selectively moving a second arresting body into and out of locking engagement with the first body. The arresting body may be spring urged into locking engagement with the first body and may be moved out of such locking engagement by means of a cam element interposed between the bodies and moved manually by a push-button or the like into a blocking position in which the cam element forces the arresting body out of engagement with the first body and in which opposite surfaces of the cam element engage the respective bodies. The mechanism may be arranged to provide automatic release of the arresting body so that it re-engages and locks the first body by returning the cam element to a non-blocking position through friction generated between the inter-engaging surfaces of the cam element and the first body when the first body is moved in one direction.

As applied in a spring roller-mounted safety screen of the kind referred to above, the first body may, for example, comprise a ratchet-wheel attached to the screen roller and the arresting body may be a leaf spring-type pall urged into engagement with the ratchet wheel so as to allow the roller to rotate in a direction retracting the screen onto the roller with a ratcheting action but preventing the roller rotating in a direction paying out the screen. To unlock the ratchet wheel, the cam element is interposed between a cylinder integral with the ratchet wheel and the pall, so that the cam element when moved by a push-button controller forces and holds the pawl away from the ratchet wheel by engaging the circumference of the cylinder at its one end and the pawl at its other end. This allows the screen to be extended to a required position and the arrangement is such that when the screen is then released and tends to rewind on the spring roller, friction developed between said cylinder and the cam member moves the cam member out of blocking engagement between the cylinder and the pawl allowing the pawl to spring back into locking engagement with the ratchet wheel thereby precluding any further extension of the screen.

Additional features and advantages of the invention will become apparent from the ensuing description and claims read in conjunction with the attached drawings.

BRIEF DESCRIPTION OF THE DRAWINGS

FIG. 3 is a front elevational view of a child safety screen in a doorway, the screen incorporating a control mechanism according to the invention;

FIG. 4 is an elevational view of the screen;

DETAILED DESCRIPTION OF THE PREFERRED EMBODIMENTS

Figure 2:
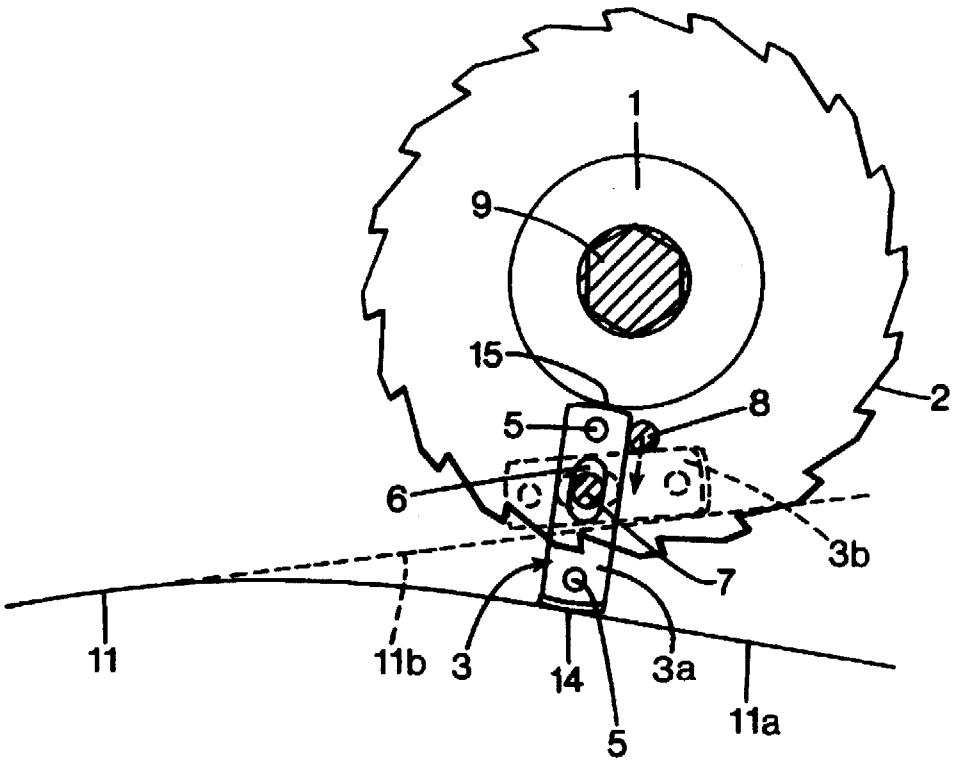
FIGS. 1 and 2 are somewhat diagrammatic side and front elevational views respectively of a control mechanism according to the invention.
Figure 1:
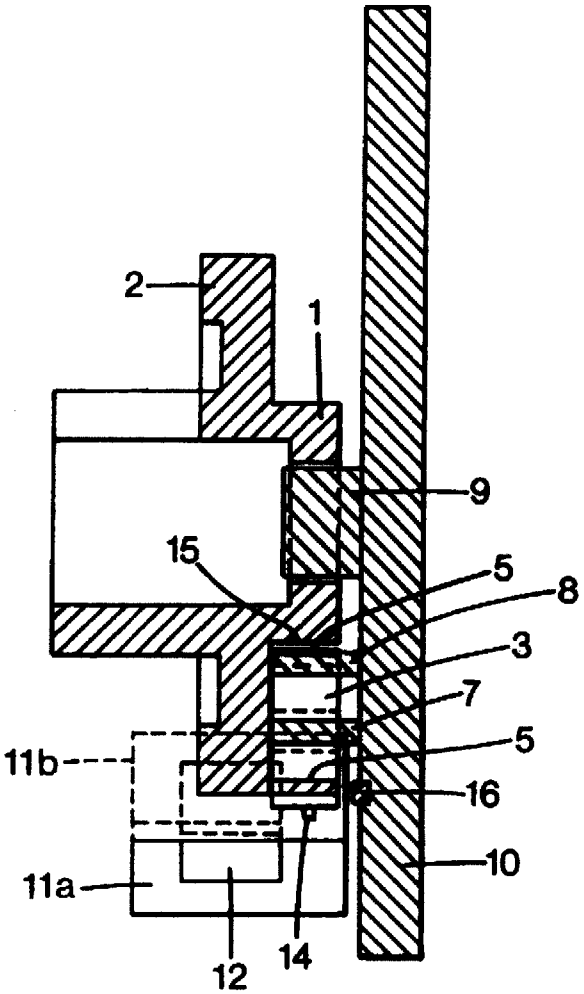
Figure 6:
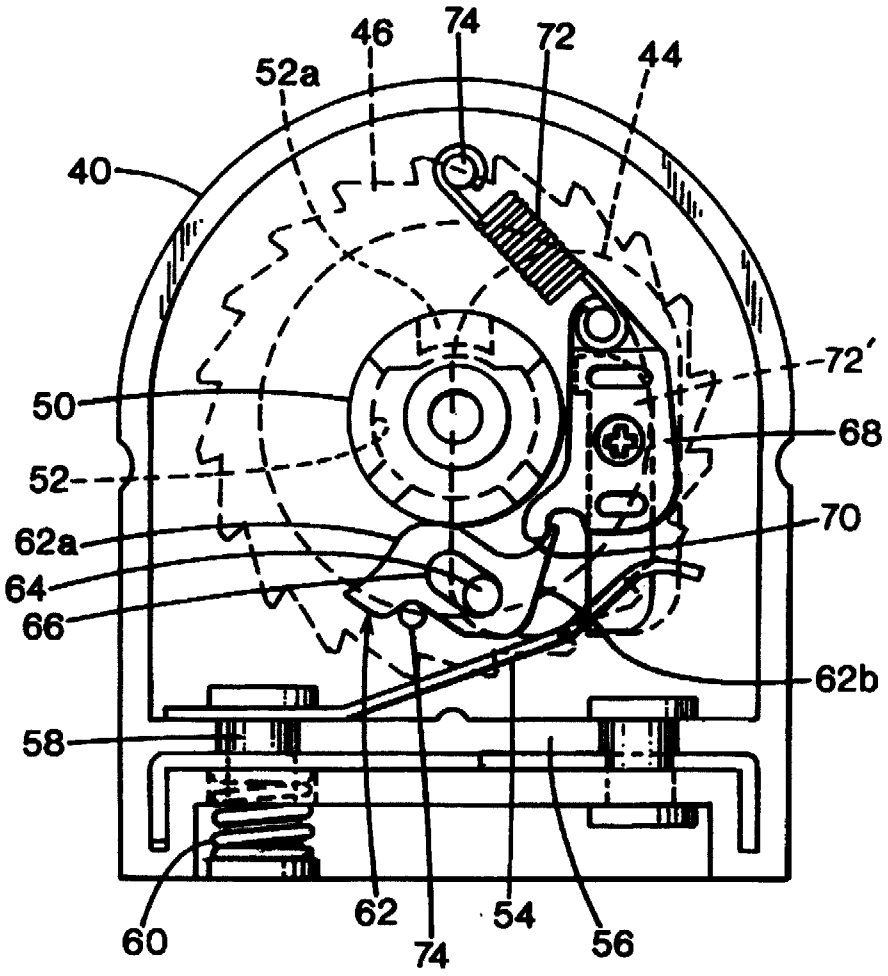
FIG. 6 is a somewhat diagrammatic sectional view through the end cap generally perpendicular to the view shown in FIG. 5.
Figure 5:
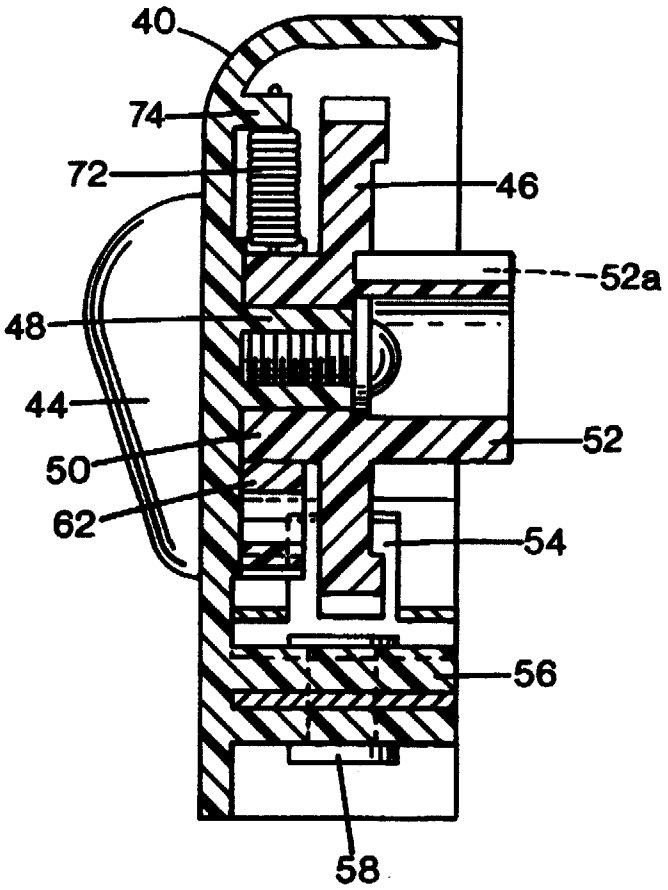
FIG. 5 is a sectional view through one of the screen end caps showing parts c,f the control mechanism.

FIGS. 1 and 2 illustrate a control mechanism for a first body comprising a ratchet wheel 2 mounted for rotation on a shaft 9 extending from a base member 10. The ratchet wheel is provided with an arresting body comprising a pawl 11 in the form of a slotted leaf spring urged towards a position **11*b*, in which the slot 12 in the pawl engages with the ratchet teeth to permit ratcheting movement of the wheel in the clockwise direction and prevent rotation in the anti-clockwise direction. The ratchet wheel is provided on its undersurface with an integral cylinder 1**.

In order to disengage the pawl 11 from the teeth of the ratchet wheel, so that the wheel can be rotated in the anticlockwise direction, an elongate substantially elliptically-shaped cam member 3 is interposed between cylinder 1 and the pawl. The cam member has a central slot 6 by which it is mounted for movement around a peg 7 extending from base member 10. A movable stud 8 is provided for manually pushing down on the cam member, as shown by the small arrow in FIG. 2 to rotate the cam member from the **3*b* position into the 3*a* position wherein the cam member holds the pawl in the 11*a* position away from the ratchet wheel teeth. In this position opposite surfaces of the cam member engage against the cylinder 1 and pawl respectively at points 15 and 14**.

With the cam member in blocking position **3*a* holding the pawl 11 away from the ratchet wheel, the wheel is thus freed to rotate in the anticlockwise direction. In this direction of rotation, even though friction is developed between the cylinder 1 and the cam member 3 at point 15 and this friction is greater than the friction developed between the cam member and the pawl at point 14 (the cam member and cylinder may comprise relatively higher friction, plastic materials and the pawl may be metal thus producing differential friction coefficients between cam member and cylinder and the cam member and pawl), nevertheless, the cylinder 1 cannot move the cam member out of its blocking position 3*a* because the stud 8, returned to its initial position shown in FIG. 2, forms a stop for the cam member. When, however, the ratchet wheel is rotated in the clockwise direction, the increased friction developed at point 15 compared to that developed at point 14 will cause the cam member to rotate back into the 3b position allowing the pawl to snap back into the operative 11b** position engaging the teeth of the ratchet wheel.

It is possible, in a modification, for the stud 8 to be fixed in position and for the cam member 3 to be moved into the 3a position by other means such as electronically or magnetically by means of magnetic or electronic elements 5 embedded therein. These devices may be operated by transducers, timers, and the like.

FIGS. 3–9 show how a control mechanism of the kind just described may be incorporated in a pull-out child safety screen. As seen in FIGS. 3 and 4, the pull out screen, generally designated 20, is mounted to form a child safety barrier across a door opening 22. The screen comprises a length of suitable plastic or other sheet material 24 wound on a roller 26 in a suitable elongate barrel 28 or the like secured vertically by any convenient means on one side of the doorway. The roller is spring-loaded in barrel 28 in a manner well-known in the art for roller blinds and the like, so that the roller tends to rotate under the influence of an internal spring, not shown, in a direction winding the material 24 onto the roller. At its inner end the material 24 is provided with a bead 30 fitting in a profiled slot 32 in reel 26 (See FIG. 9) and at its outer end, the sheet material has a pivotal end piece terminating in a T-bar 34, one limb of which can be received in a slot 36 formed in an elongate plastic keeper 38 suitably attached on the opposite side of the doorway.

The barrel 28 has upper and lower end caps 40,42 the upper end cap including a control mechanism for the roller similar to the mechanism shown in FIGS. 1 and 2 and described in detail below. A push-button 44 extends from the upper end cap. The arrangement is such that the roller is normally locked by the control mechanism against rotation in a direction allowing the screen material to be pulled out and extended. When the push button 44 is operated, however, the roller is released, allowing the screen to be pulled out until the T-bar 34 is engaged with the keeper 38. Then, when the T-bar is released the internal spring pressure within the roller 26 tends to rotate the roller in a direction to retract the screen material. This action causes the control mechanism automatically to once again lock the roller against outward rotation, so that the screen material cannot extend when impacted by a child. If some outward movement is required in order to release the T-bar from the keeper, this can be effected by again operating the push-button and the screen will then be reeled in by spring action.

The control mechanism inside of end cap 40 includes a ratchet wheel 46 rotatably mounted on a post 48 molded in the end cap, (see FIG. 5) the ratchet wheel being integrally formed with a cylinder 50 on one side and a hub 52 on the other side. The hub fits into one end of roller 26 and a radial projection 26a on the roller (see FIG. 9) fits a corresponding depression 52a in the hub causing the roller and the ratchet wheel to rotate together. A slotted metal lever 54 mounted on an end wall 56 of the end cap forms a pawl for the ratchet wheel in like manner to the pawl 11 of the first embodiment. The pawl is spring-biased to engage the ratchet wheel by a floating barrel-shaped pin 58 extending through apertures in the pawl and in wall 56, the pin being surrounded by a coil spring 60 exerting downward pressure on the pin and urging the pawl upwardly into engagement with the ratchet wheel. The ratchet wheel teeth are angled in a direction allowing the wheel to rotate clockwise in the drawings (corresponding with rotation of roller 26 in a direction pulling the screen material 24 inwardly onto the roller) but so that the pawl prevents anticlockwise rotation (corresponding with rotation of roller 26 in a direction allowing the material 24 to be pulled out).

To move the pawl 54 away from the ratchet wheel teeth, an elongate cam member 62 is interposed between the pawl and cylinder 50. The cam member is mounted on a pin 64 molded in the end cap and fitting in a slot 66 in the cam member. A pusher 68 with a cam member-engaging tail 70 rides in an arcuate slot 72' in the end cap, the pusher being attached outside of the end-cap to the push-button 44. The push-button and pusher can be pushed manually down the slot by sideways and downward pressure on the push-button (see the two-way arrow on the push-button in FIG. 4) against the pressure of a coil spring 72 connected between the pusher and a pin 74 molded in the end cap.

In the normal position of pawl 54 (FIG. 6), the pawl engages the ratchet wheel teeth, preventing the wheel from rotating anticlockwise so that the screen material 28 cannot be extended. To extend the screen, the push button 44 is pushed sideways and down accompanied by pusher 68 (the two-part movement is provided to discourage actuation by small children) thereby causing the pusher tail 70 to swing cam member 62 around pin 64 from the FIG. 6 position into the FIG. 7 position, in which the cam member forces the pawl 54 down out of engagement with the ratchet wheel teeth until the upper curved surface 62a of the cam member engages against the surface of cylinder 50 and the lower flat surface 62b of the cam member engages against the pawl. When the push button 44 is released, pusher 68 is returned by spring 72 to the original upper position, see the dotted line in FIG. 7, but the cam member retains its FIG. 7 position holding the pawl out of engagement with the ratchet wheel teeth. In this condition, the ratchet wheel (and roller 26) can now be rotated anti-clockwise to extend the screen. In such rotation of the ratchet wheel, as in the previous embodiment, a friction force is developed between the cylinder 50 and the upper curved surface 62a of the cam member but this is smaller than the friction force developed between the lower flat surface 62b of the cam member and the pawl because of the shapes of the respective surfaces. Therefore, such friction differential prevents the cam member from being tilted out of the FIG. 7 position, so that the pawl is retained in its non-operative position.

Figure 8:
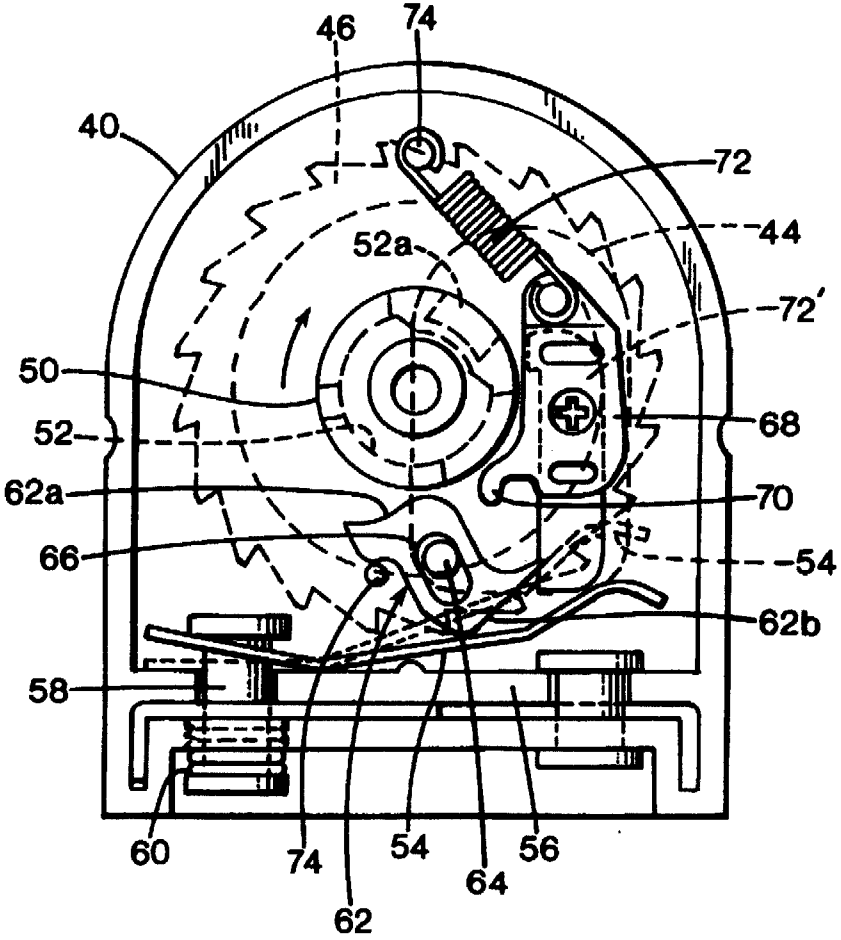
FIGS. 7 and 8 are views similar to FIG. 6 showing different positions of the control mechanism.
Figure 7:
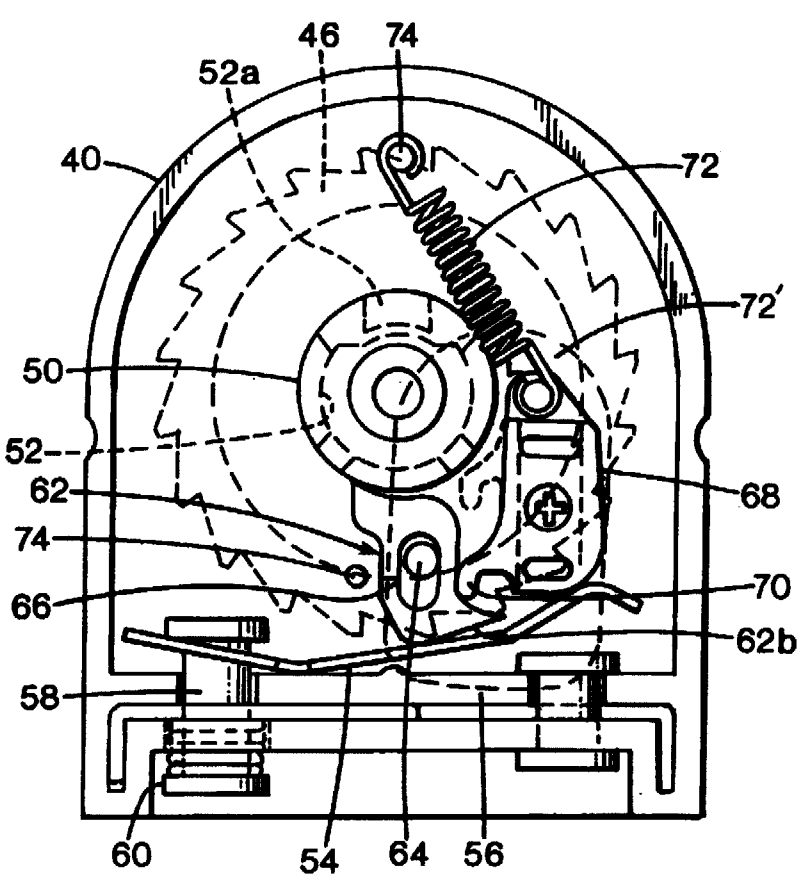
Figure 9:
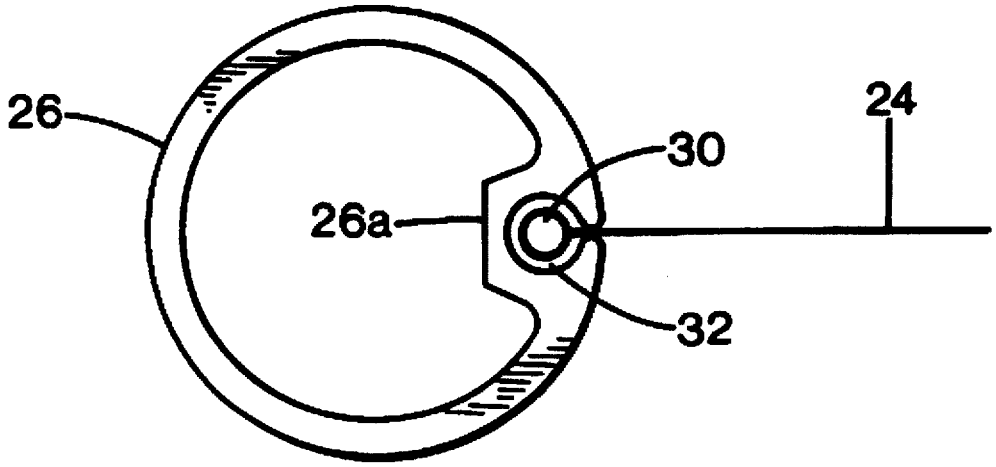
FIG. 9 is an end view of a screen roller.

When, however, the ratchet wheel starts to move in the opposite or clockwise direction (when the T-bar 34 is released and the internal roller spring mechanism tends to wind up the screen) then the friction force developed between cylinder 50 and the upper curved surface 62a of the cam member and directed against the left-hand upper point of surface 62a, becomes greater than the friction force at surface 62b and the top of cam member is moved to the left as seen in FIG. 8. The blocking condition of the cam member is thus removed and the pawl 54 is free to re-engage the ratchet wheel teeth under the influence of spring 60. The cam member is returned to the FIG. 7 position in which it encounters a stop 74.

As an alternative to the above means for developing differential friction forces in opposite directions of ratchet wheel rotation, the pusher 68 can be located such that the tail 70 forms a stop for the cam member preventing it from being moved when the ratchet wheel is rotated in the anticlockwise direction, in similar manner to the stud 8 in FIGS. 1 and 2.

It will be understood that screen structures according to the invention have diverse applications other than their use as child safety barriers and that control mechanisms according to the invention likewise have diverse applications other than their use for ratchet wheel controls. For example the cam member and differential friction assembly can be used between a first body and a second arresting body wherein the first body is subject to translatory rather than rotational motion as described above.

While only preferred embodiments of the invention have been described herein in detail, the invention is not limited thereby and modifications can be made with the scope of the attached claims.

I claim:

1. In a spring roller-mounted pull-out screen structure comprising a length of screen material wound on a roller which is journalled between opposite end caps of an elongate casing and which is spring-biased to rotate in a first direction for winding the material onto the roller, the improvement comprising a roller control mechanism including a rotary body connected to the roller for rotation therewith, an arresting body releasably engaged with the rotary body having means for locking the roller against rotation in a second direction unwinding the material from the roller while permitting rotation of the roller in the first direction, manually operable means for moving the arresting body out of engagement with the rotary body enabling the roller to be rotated in the second direction and motion responsive means for automatically re-engaging the arresting body with the rotary body responsive to rotation of the roller in the first direction.

2. The improvement as claimed in claim 1 wherein the rotary body comprises a ratchet wheel and the arresting body comprises a pawl biased into engagement with teeth on the ratchet wheel.

3. The improvement as claimed in claim 1 wherein the casing is mounted on one side of an access opening for pulling the screen material across the opening to provide a safety barrier which is substantially non-extendible when impacted upon, wherein the screen material has an outer end formed as one part of a releasable grip and wherein a complimentary part of the grip is mounted on an opposite side of the opening.

4. In a spring roller-mounted pull-out screen structure comprising a length of screen material wound on a roller which is journalled between opposite end caps of an elongate casing and which is spring-biased to rotate in a first direction for winding the material onto the roller, the improvement comprising a roller control mechanism including a rotary body connected to the roller for rotation therewith, an arresting body releasably engaged with the rotary body for locking the roller against rotation in a second direction unwinding the material from the roller, manually operable means for moving the arresting body out of engagement with the rotary body enabling the roller to be rotated in the second direction and motion responsive means for automatically re-engaging the arresting body with the rotary body responsive to rotation of the roller in the first direction, wherein the rotary body comprises a ratchet wheel and the arresting body comprises a pawl biased into engagement with teeth on the ratchet wheel, further wherein the motion responsive means comprises a cylinder integral with the ratchet wheel and a moveable cam member interposed between the cylinder and the pawl, the cam member having a blocking position with opposed surfaces thereof engaging the cylinder and the pawl respectively when the pawl is moved out engagement with the ratchet wheel, with differential friction forces being developed between said opposed surfaces and the cylinder and pawl respectively when the cylinder is rotated in opposite directions for automatically moving the cam member out of the blocking position when the cylinder is rotated in the first direction and for preventing the cam member being moved out of the blocking position when the cylinder is rotated in the second direction.

5. The improvement as claimed in claim 4 wherein the manually operable means comprises a pusher connected to a manual push-button externally mounted on the end cap for moving the pawl out of engagement with the ratchet wheel teeth by pushing the cam member from a non-blocking position into the blocking position.

6. The improvement as claimed in claim 5 including a spring for returning the push-button and pusher to an initial position upon release of the push button after moving the pawl out of engagement with the ratchet wheel teeth.

7. The improvement as claimed in claim 6 including a bi-directional slot in one of said end caps on which the push-button is mounted for guiding movement of the push-button and pusher.

8. The improvement as claimed in claim 6 wherein for developing said differential friction forces, the cam member has a curved surface for engaging the cylinder and a substantially flat surface for engaging the pawl.

9. A bidirectionally movable body in combination with a control mechanism for controlling movement of the bidirectionally movable body in a first direction, the control mechanism comprising an arresting body having a first position proximal the moveable body for arresting movement of the movable body in said first direction and a second position distal the moveable body releasing the moveable body for movement in said first direction; biasing means urging the arresting body toward the first position, a moveable cam member interposed between the bodies the cam member having a blocking position holding the arresting body in the second position with opposite surfaces of the cam member in frictional engagement with the respective bodies, the respective bodies developing differential friction forces with the cam member for inducing movement of the cam member out of the blocking position responsive to movement of the moveable body in a second direction opposite said first direction and the mechanism further including means preventing the cam member being moved out the blocking position responsive to movement of the moveable body in the first direction.

10. A combination as claimed in claim 9 wherein the moveable body comprises a rotary body.

11. A combination as claimed in claim 10 wherein the rotary body comprises a ratchet wheel with an integral cam-engaging cylinder and the arresting body comprises a pawl engageable with teeth on the ratchet wheel.

12. A combination as claimed in claim 9 which includes a manual pusher for moving the cam member into the blocking position.

13. A combination as claimed in claim 12 wherein the means preventing the cam member being moved out of the blocking position responsive to movement of the moveable body in the first direction comprises a stop formed on the pusher.

14. A combination as claimed in claim 12 wherein the means preventing the cam member being moved out of the blocking position responsive to movement of the moveable body in the first direction comprises respective surface formations on said opposite surfaces of the cam member.

* * * * *